United States Patent [19]

Brotz

[11] Patent Number: 4,684,336

[45] Date of Patent: Aug. 4, 1987

[54] APPARATUS FOR BULK PRODUCTION OF CARBON FIBERS

[76] Inventor: Gregory R. Brotz, P.O. Box 1322, Sheboygan, Wis. 53081

[21] Appl. No.: 828,228

[22] Filed: Feb. 10, 1986

Related U.S. Application Data

[63] Continuation-in-part of Ser. No. 691,150, Jan. 14, 1985, abandoned.

[51] Int. Cl.[4] ..... B22F 9/00

[52] U.S. Cl. ..... 425/8; 264/27; 333/227; 425/76; 425/174; 425/405 R; 425/DIG. 60

[58] Field of Search ..... 425/8, 174, 76, 405 R, 425/DIG. 60; 264/10, 8, 27, 29.2; 65/8, 15; 333/227

[56] References Cited

U.S. PATENT DOCUMENTS

| | | | |
|---|---|---|---|
| 2,269,456 | 1/1942 | Hansen et al. | 333/227 X |
| 3,250,832 | 5/1966 | Metz | 264/27 |
| 4,178,336 | 12/1979 | Snowden | 264/8 |
| 4,265,730 | 5/1981 | Hirose et al. | 156/345 X |
| 4,294,783 | 10/1981 | Snowden | 264/8 |
| 4,301,135 | 11/1981 | Nazem et al. | 264/29.2 X |
| 4,334,844 | 6/1982 | Tanaka | 425/174 X |
| 4,374,075 | 2/1983 | Yolton et al. | 264/8 |
| 4,431,832 | 5/1984 | Fug | 264/29.2 X |

*Primary Examiner*—Robert L. Lindsay
*Attorney, Agent, or Firm*—William Nitkin

[57] ABSTRACT

Bulk production of carbon fibers by a spinning process incorporating the exposure of the fibers to a level of electron plasma to achieve the curing to carbonization stage as desired. Fibers are also broken into shorter lengths for particular uses.

9 Claims, 6 Drawing Figures

APPARATUS FOR BULK PRODUCTION OF CARBON FIBERS

This application is a continuation-in-part of my previous application of the same title filed Jan. 14, 1985, Ser. No. 691,150 now abandoned.

BACKGROUND OF THE INVENTION

1. Field of the Invention

This invention relates to an apparatus and method for the production of fibers and more particularly relates to the spinning of fibers having a discontinuous nature through an electron plasma, such fibers having special characteristics.

2. Description of the Prior Art

There is significant prior art in the art of spinning fibers. U.S. Pat. No. 1,357,206 to Fuller is an older patent showing the basic structure in this art wherein a viscous liquid material is entered into a revolving vessel or container having a side wall containing a plurality of openings through which the viscous material is forced in fine streams by centrifugal force and after these streams leave the rotating central vessel, they are solidified into fibers. A variety of processes are used in the prior art for this solidification process which include hot air, heat, chemical vapors, sprays of other liquids and microwaves. The formed fibers usually fall to an area where they are collected.

Prior art in the area of plasma generated by a microwave discharge can be found in U.S. Pat. No. 4,265,730 to Hirose et al for Surface Treating Apparatus Utilizing Plasma Generated by Microwave Discharge and in the book *Techniques and Applications of Plasma Chemistry* edited by Hollahan and Bell published by John Wiley & Sons. An electron beam oscillator is disclosed in U.S. Pat. No. 2,269,456 to W. W. Hansen et al.

SUMMARY OF THE INVENTION

It is an object of this invention to disclose an improved method for the production of bulk fibers by a spinning process.

It is a further object of this invention to use, for example, a carbonizable resin in such process and produce carbon fibers by means of passing the just-spun fibers through an electron plasma. The fibers exposed to the plasma can be processed to a variety of stages including being cured, carbonized and/or graphitized. The fibers can also be broken into segments by physical means and in an alternate embodiment, can have granules embedded in them to assist in the breaking up of the spun fibers.

DESCRIPTION OF THE PREFERRED EMBODIMENT(S)

Figure 1:
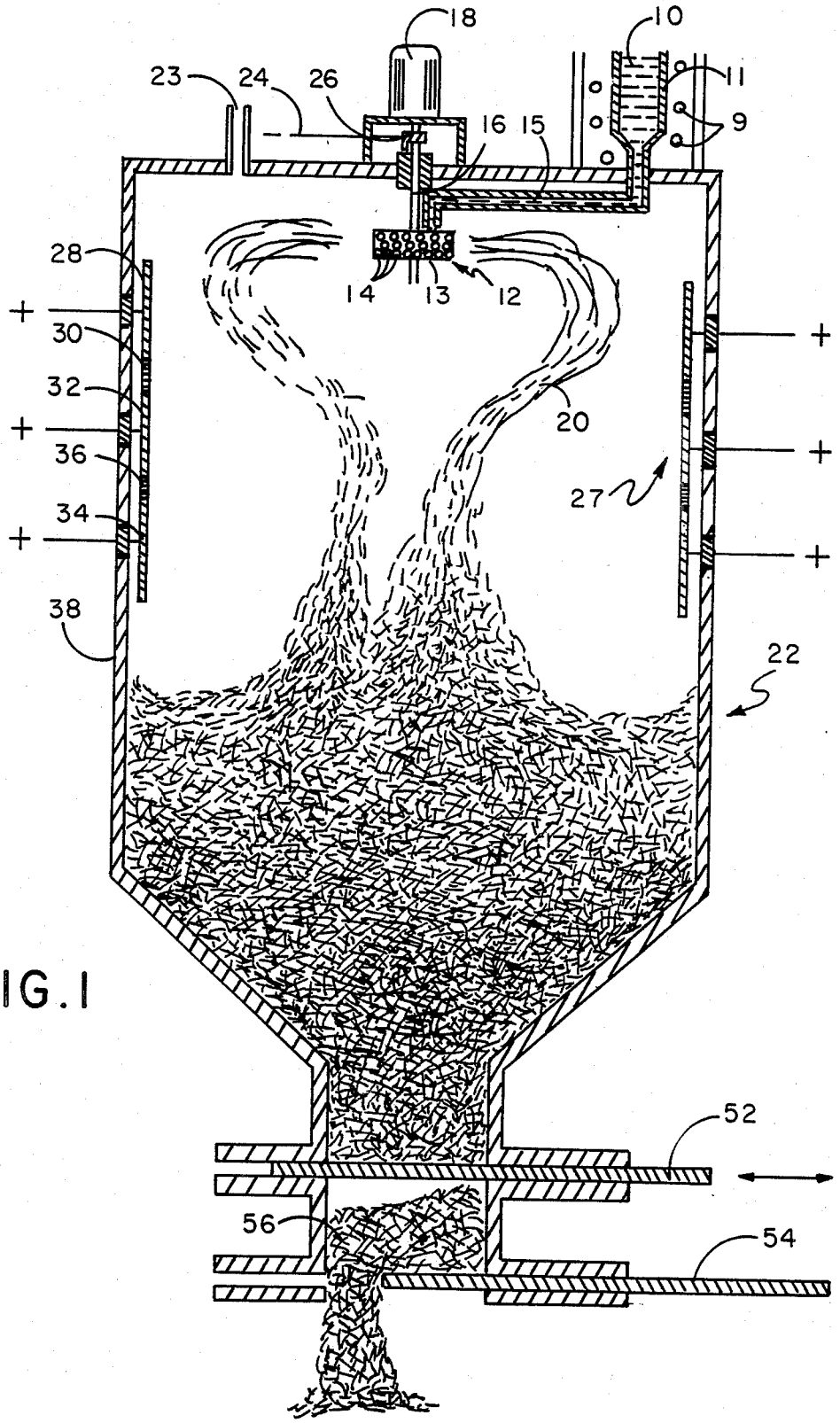
FIG. 1 illustrates a spinning process bulk fiber production apparatus utilizing the electron plasma of this invention.

FIG. 1 illustrates a device for the production of bulk fibers by a spinning process. The fibers produced can be utilized for a variety of purposes including the production of various structures. A carbonizable resin 10 such as a phenolic or polymid in solution type is introduced into the device from holding tank 11 which in some embodiments is under pressure as discussed below in relation to FIG. 2. The resin is maintained as a liquid in holding tank 11 by means of electric coil heaters 9 surrounding holding tank 11. The resin passes through tube 15 into basket spinner 13 which is in the form of vessel 12 having a plurality of vessel apertures 14 arrayed in its outer surface. Basket spinner 13 is affixed by shaft 16 to means for its rotation such as motor 18. As the resin enters rotating basket spinner 13, centrifugal force forces the resin out of the vessel apertures causing resin 10 to form into streams which are solidified as described below and which then fall to the bottom of vat 22 where they are collected and held for use. The atmosphere in vat 22 can, in this embodiment, be evacuated through port 23 to create a vacuum therein which aids in forming an electron plasma between the electrodes provided in the device. First pole electrode 24 can be connected to basket spinner 13 by contact of electrode brush 26 to shaft 16. Second pole electrode 27, which can be cylindrical in shape and concentric within the walls of vat 22, can be comprised of one or more electrodes such as the second pole first electrode 28 insulated by insulator 30 from second pole second electrode 32 and in the embodiment illustrated with three second electrodes, second pole second electrode 32 is then insulated by second insulator 36 from second pole third electrode 34. When high voltage is passed between the first pole and second pole 27, an electron plasma is created between basket spinner 13 and second pole electrodes 28, 32 and 34 as illustrated. Fibers 20 produced out of basket spinner 13 are an insulator within the path of the electron plasma between the first and second poles and as the thermosetting resin passes through the basket spinner apertures forming fiber filaments which enter the electron plasma, the electron plasma causes the fiber filaments to heat up and to cure. The voltages depend on the fiber residence time, the height of the vat, the fineness of the fiber being spun and, in the case of moving gases in the column as described below, the velocity and density of the gases and byproducts formed moving upwards in the vat. Different voltages can be connected to the individual second pole electrodes so that the rate at which the resin cures can be controlled. In an example, the first pole electrode 24 can be ground and second pole electrodes 28, 32 and 34 can each have a different voltage. In some embodiments it is desirable to have the highest and hottest voltage at the uppermost second pole electrode 28. By controlling the voltage within the first, second and third second pole electrodes at differing levels, it is possible to produce filaments with greatly varying properties from being only cured to being carbonized or graphitized. The carbonization by the electron plasma of the resin filament is dependent on the length of time that the filament is within the electron plasma field and as such the elongated electrodes of varying voltages can have a significant effect on the amount of carbonization of the fiber product within vat 22.

Vessel apertures 14 can be arranged in various configurations which can produce different characteristics in fibers 20 passing therethrough. As the fibers are spun if there is more than one row of vessel apertures arrayed vertically on the basket, the fiber filaments can become entangled and cause the resulting falling shroud of fibers to reduce in diameter away from second pole electrode 27. As the sizes of the vessel apertures vary, one can produce finer or heavier fibers filaments. The production of fibers of varying diameters can also be accomplished by varying the speed at which the basket spinner rotates and the rate at which resin is fed into the basket spinner.

Figure 3:
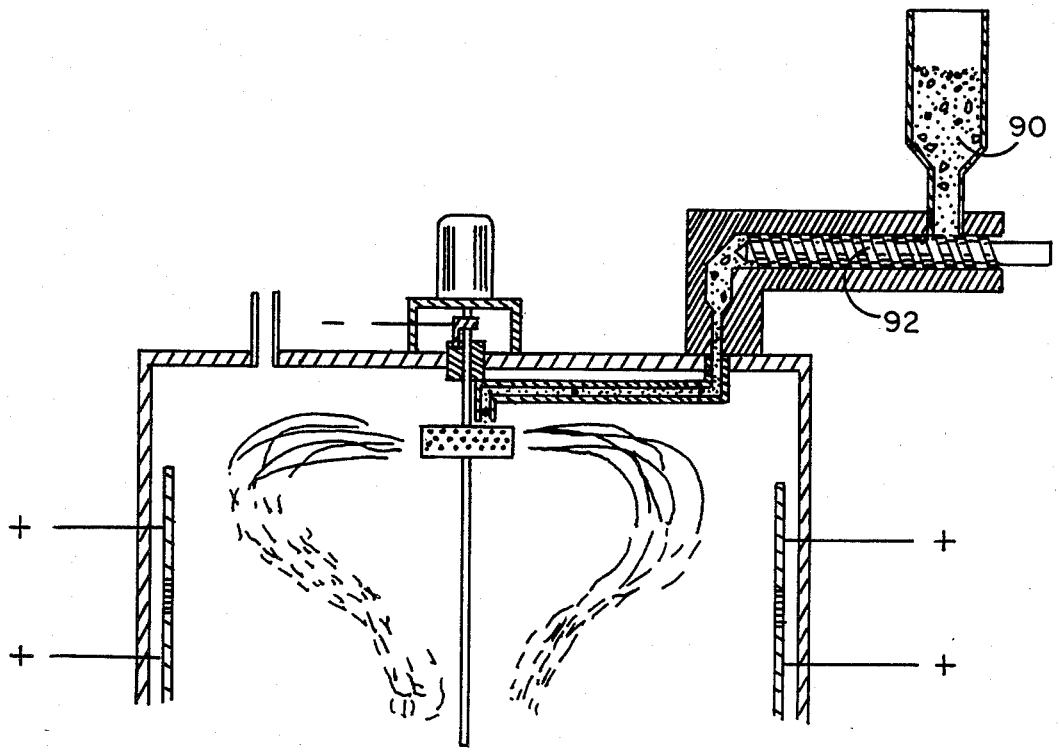
FIG. 3 illustrates means for entering granular resins into the spinning basket.

FIG. 3 shows the entry of granular resin 90 by a rotating extruder 92 into tube 15. During the progression of the granular resin, heaters can melt it to a liquid before it enters basket spinner 13.

Figure 4:
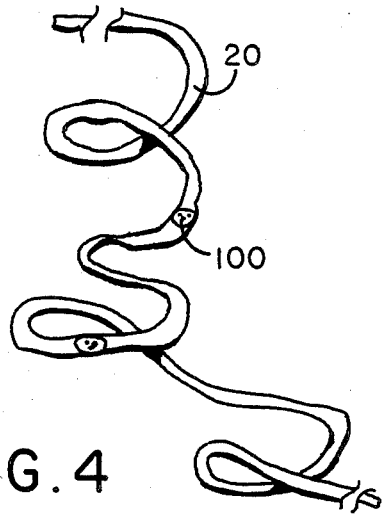
FIG. 4 illustrates a fiber filament curled by having an elastomer incorporateed into its forming material with granules embedded along its length.

It should be noted that certain additives can be placed in the resin. For example, the addition of an elastomer will have the effect of causing the filament to shrink and curl which effect can be advantageous for producing certain products from such filaments. In another embodiment granules with a specific mesh size, for example, a silicate product can be added to the resin which addition will help break up the fiber filament into short segments. In FIG. 4 is illustrated a typical curly fiber spun from a resin containing an elastomer having granules embedded within the filament. It is desirable that the diameter of the granules be close in size to the diameter of the filament being spun and the amount of the granules in resin 10 will determine the average length of the resulting individual fiber filaments.

Figure 5:
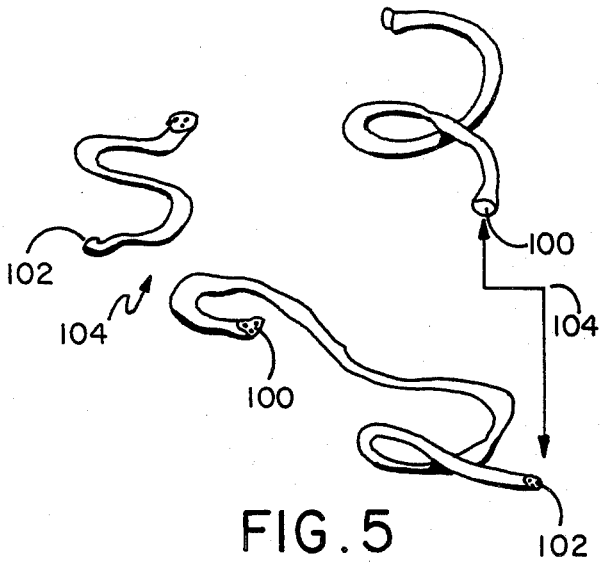
FIG. 5 illustrates the fiber filament of FIG. 4 having broken apart at the points where the granules are embedded therein.

In FIG. 5 one can see the fiber filaments which have broken apart from one another at the junction of the granules embedded within each filament forming a plurality of short curly filaments which are desirable in many embodiments.

Figure 2:
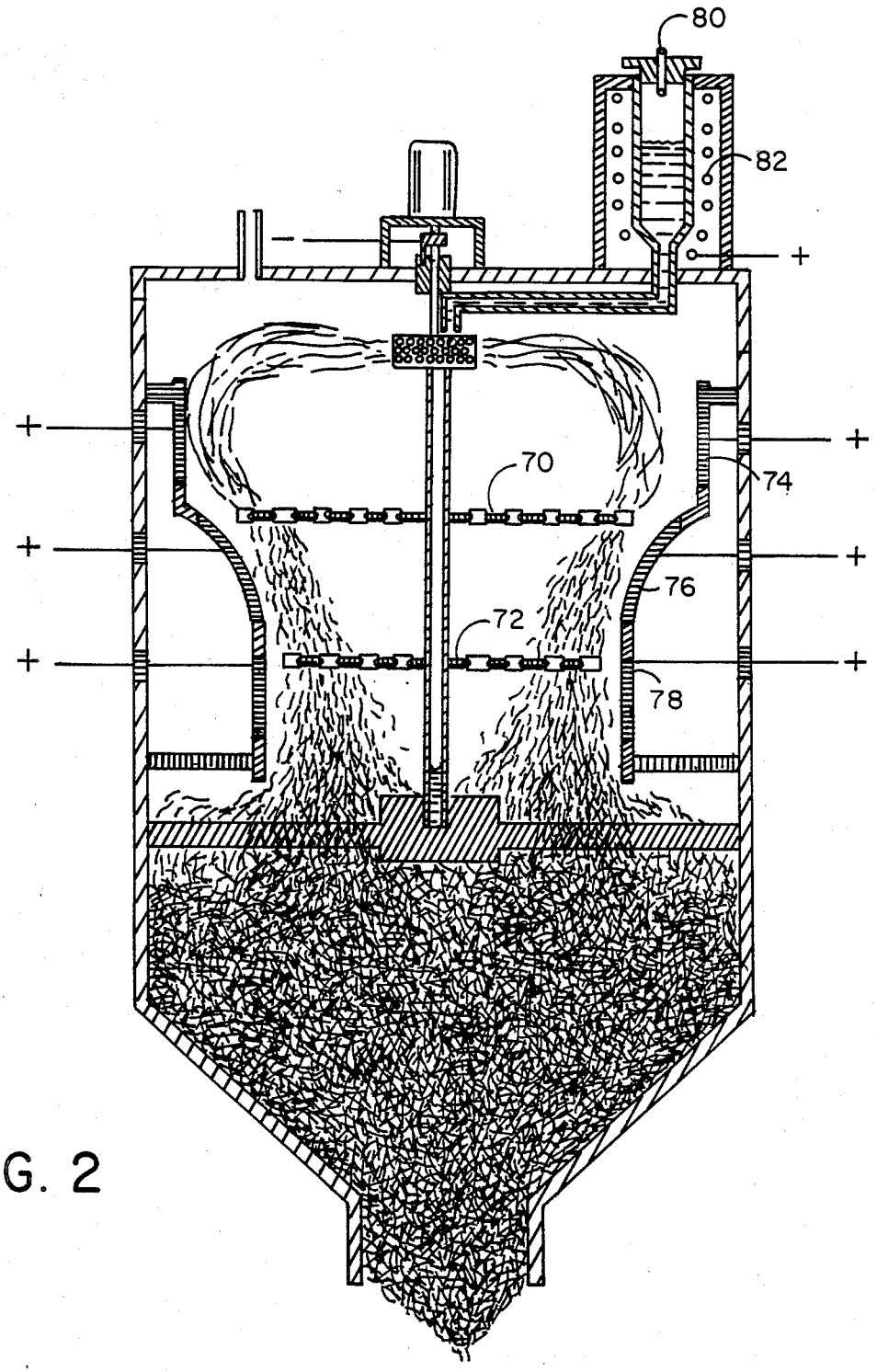
FIG. 2 illustrates a spinning process bulk fiber production apparatus utilizing breaker chains with an alternate embodiment configuration of the electron plasma producing structure.

FIG. 2 illustrates an embodiment of a production filament fiber production apparatus of this invention which has a different arrangement of the second pole electrodes, being second pole first, second and third electrodes 74, 76 and 78 respectively, to conform more closely to the shape of the falling fiber shroud. Also seen in FIG. 2 are first breaker chain 70 and second breaker chain 72 which can be constructed of a material that acts as a non-conductor such as refractory cement or equivalent within the plasma field. These chains, which are attached to the shaft which spins basket spinner 13, strike and break the falling fibers into short lengths. FIG. 2 also illustrates pressure port 80 through which pressure is applied to the resin in holding tank 11.

In an example where there are different voltages in each second pole electrode with a higher voltage being produced at each succeeding lower electrode, fibers having a low aspect ratio which is the ratio of the fiber length to its diameter being fibers which are thick and of short length, would be produced. If a higher aspect ratio were desired for the fiber filaments, a stronger current could be applied to the topmost second pole electrode causing the filament to cure and carbonize almost instantly after being extruded from the basket spinner. If the fiber filaments which fall into vat 22 fill up the vat to the point of reaching lower second pole electrode, they will be exposed to its electron plasma which would increase the total length of time that the fiber filaments are exposed to the plasma and their resulting carbonization level.

The escapement seen in FIG. 1 can remove the fiber filaments from vat 22 at a desired rate by opening first gate 52 and allowing a certain amount of the fiber filaments to fall into chamber 56. Then, by closing first gate 52 and opening second gate 54, the segregated amount of fiber filaments is released to be delivered to a utilization area. This fiber filament removal process can maintain a desired fiber filament level in vat 22 if performed at a particular rate in relation to the rate of exit of the resin through the basket spinner. If the level of the fiber filaments is at the location of the lower second pole electrode, the filaments will be acted upon by the electron plasma and this increased exposure time can be used to further carbonize the filaments. It should be noted that once the fiber filaments are conductive, they will carry current and will heat up to very high temperatures between the electrodes because of their own resistance. At some point a conduction equilibrium would be reached between the resistance value of the carbon at the temperature and the electron carrying capability of the level of vacuum that exists in the chamber. This equilibrium creates a self-regulating relationship between the level of vacuum in the chamber and the products of carbonization. When a high-volume vacuum pump is used through port 23, a faster spinning rate can be maintained.

Figure 6:
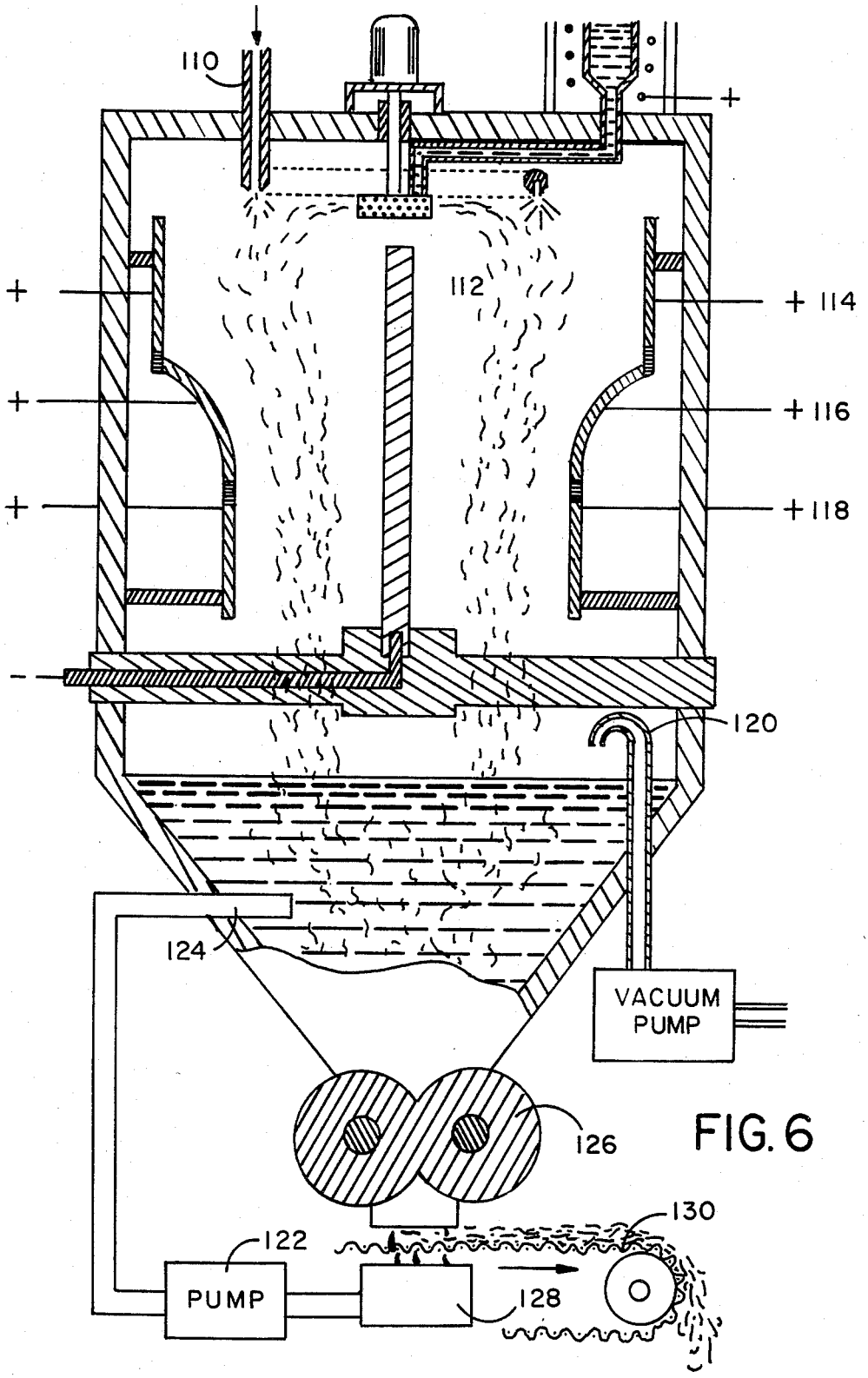
FIG. 6 illustrates an alternate apparatus for spinning fibers.

In some embodiments such as seen in FIG. 6 a vacuum might not be utilized but instead in another embodiment gases or liquid reactant may be circulated in the vat. Such gases or liquid reactant might react or catalyze with the resin being spun and further the vat may at the same time be at a reduced pressure to facilitate electron flow. In FIG. 6 a liquid reactant such as an acid is introduced through port 110 so that it sprays on the fibers which can be a single stage phenolic being spun below and reacts therewith. A plasma is formed between central pole 112 and pole electrodes 114, 116 and 118. A vacuum port 120 at the bottom of the chamber reduces the pressure in the vat and removes unwanted byproducts of the reaction. A pump 122 returns the liquid reactant from catch basin 128 through port 124 to maintain a level of fluid in the vat so that the atmosphere, whether at reduced pressure or at a zero vacuum, can be maintained. The treated fibers are removed through gate 126 to a conveyor 130 to be transported away from the vat. While non-vacuum processing can be utilized such as in the above embodiment, the utilization of a vacuum has many advantages when using plasma techniques. The electrical resistance in a vacuum is close to zero so that the voltage and power needed to produce a spark gap are low and a high power plasma can be created between the electrodes. Less than a pure vacuum such as a vat under low pressure conditions will require more voltage and power. Processing in a pure vacuum condition creates an inert atmosphere to eliminate any oxygen to prevent the formation of carbon dioxide. A vacuum is more economical to use than inert gases such as nitrogen due to the expense of the gas and the vacuum further facilitates the degassing of fibers which may produce water due to the polycondensation reaction as they cure.

In the embodiment with gas exchanging in the vat, if such gas is passed from the bottom of the vat to the top, it would hold the spun fibers in the plasma field longer due to the upwards movement of the gas tending to support the fiber as they fall. Further, the spinning ceramic chains also would increase the residence time as they would cause the fibers to take a less direct path to the collection bed at the bottom of the vat. Fiber residence times in the plasma field could be approximately 2.2 seconds but depending on a variety of variables as mentioned above, the time could be greater or lower. Lower residence times may occur in pure vacuums. The vat may be configured even as part of a Klystron generator and the frequency of the microwaves may be in the 900–30,000 MHz range at a power between 10 W and 30 KW. As mentioned above other frequency and power ranges may be necessary due to the variety of factors such as vat size, fiber profile, residence time, and whether the vat has therein under low pressure inert gases or whether the vat is in a pure vacuum condition and the nature of the plasma, each of which factors being subject to variation. Wider vats would require higher voltages for a longer spark.

If the fiber material is of a polar nature during any phase of its decomposition from an organic polymer to carbon, the direction of the falling fibers can be affected by using alternating current across the poles biased either to the center pole or the vat wall.

Since carbon sublimes at high temperatures, vacuum processing must be carefully regulated. This sublimation increases at low pressures so that in a vacuum situation the problem is greater. Therefore it is important to remove the carbon fibers from the vat as soon as they are produced. It should be noted however that a very hard vacuum may not be necessary as long spark gaps can be produced with merely low pressures. As the sublimation temperature of graphite is above 3600 degress C., fibers can be produced below this temperature to eliminate this possible problem.

It should be noted that the device of this invention can be used in fields other than the production of fibers such as spray-drying of materials. Even particulated molten metal could be treated as it falls through the plasma into a liquid or cryogenic fluid at the bottom of the vat. Only the irradiated metal particles heat as there is no heat conduction or heat convection in the chamber and a cold fluid could be maintained in the bottom thereof without much warming as the only heat would come from the heated particles. Such vacuum-processed metal, when quench cooled, has an amorphous structure which is useful in industry especially when rolled together to interfuse and orient the grains.

Although the present invention has been described with reference to particular embodiments, it will be apparent to those skilled in the.art that variations and modifications can be substituted therefor without departing from the principles and spirit of the invention.

I claim:

1. An apparatus for spinning fibers comprising:

a generally cylindrical chamber having a top and bottom;

a material to be spun into fibers; and a rotating basket spinner in said chamber disposed near the top of said chamber adapted to receive said material and to produce fiber filaments;

a first pole electrode contacting said rotating basket spinner;

at least one open generally cylindrical second pole electrode positioned concentrically to the sides of said chamber below said rotating basket spinner through the open area of which falls said fiber filaments; and means to provide an electron plasma between said basket spinner through said first electrode and said second electrode in said chamber through which electron plasma said fibers pass, said plasma adapted to change the state of said fiber filaments.

2. The apparatus of claim 1 wherein said chamber has a vacuum condition defined therein.

3. The apparatus of claim 1 wherein said chamber has an atmosphere of inert gases under low pressure.

4. The apparatus of claim 1 further including a plurality of open cylindrical pole electrodes each of independently adjustable voltage from one another positioned below with said opening aligned with the opening of said second pole electrode to produce said electron plasma to configure the fiber filament product passing therethrough.

5. The apparatus of claim 4 wherein said first pole electrode does not contact said basket spinner but is a pole centrally located within said opening of said open cylindrical second pole, said apparatus further including:

means to spray material on said fibers after they have been spun;

liquid reactants contained at the bottom of said chamber into which liquid said fibers fall;

a gate to allow discrete amounts of fibers and liquids to be removed from said chamber;

means to catch any of said liquid passing out of said chamber with said fibers and to return said liquid to said chamber; and a vacuum pump appling vacuum to said chamber.

6. The apparatus of claim 4 wherein said open cylindrical electrodes are of varying diameters to affect the configuration of the resultant fiber filament product.

7. The apparatus of claim 1 further including means to break said fiber filaments comprising:

a plurality of granules added to said material to be spun into fibers, said granules forming weak points at their position in said formed fibers, said spun fiber filaments adapted to break at the points of contact of fiber filament materials and said granules embedded therein.

8. The apparatus of claim 7 wherein said granules are similar in size to the diameter of said fiber filament.

9. The apparatus of claim 6 further including:

a shaft extending downward from said basket spinner adapted to rotate when said basket spinner rotates; and at least one breaker chain of non-conductive material affixed to said shaft adapted when said shaft rotates to strike and break the falling fibers.

* * * * *